US008474918B2

(12) United States Patent
Hackelboerger et al.

(10) Patent No.: US 8,474,918 B2
(45) Date of Patent: Jul. 2, 2013

(54) METHOD AND DEVICE FOR MONITORING A CUTTING EXTRACTION MACHINE

(75) Inventors: Bernhard Hackelboerger, Castrop-Rauxel (DE); Arnold Schymonski, Essen (DE); Reik Winkel, Aachen (DE); Karl Nienhaus, Raeren (BE)

(73) Assignee: Eickhoff Bergbautechnik GmbH, Bochum (DE)

( * ) Notice: Subject to any disclaimer, the term of this patent is extended or adjusted under 35 U.S.C. 154(b) by 72 days.

(21) Appl. No.: 12/452,415

(22) PCT Filed: Aug. 9, 2008

(86) PCT No.: PCT/EP2008/006589

§ 371 (c)(1),
(2), (4) Date: Dec. 29, 2009

(87) PCT Pub. No.: WO2010/017823

PCT Pub. Date: Feb. 18, 2010

(65) Prior Publication Data

US 2010/0194175 A1 Aug. 5, 2010

(51) Int. Cl.
*E21C 35/14* (2006.01)

(52) U.S. Cl.
USPC ..... 299/1.6

(58) Field of Classification Search
USPC ..... 299/1.05–1.9
See application file for complete search history.

(56) References Cited

U.S. PATENT DOCUMENTS

| | | | | |
|---|---|---|---|---|
| 4,330,154 | A | 5/1982 | Harris | |
| 4,465,155 | A * | 8/1984 | Collins | 180/169 |
| 4,715,657 | A | 12/1987 | Sato et al. | |
| 5,079,640 | A * | 1/1992 | Gfrerer | 398/109 |
| 5,668,739 | A * | 9/1997 | League et al. | 382/103 |
| 2008/0185903 | A1 * | 8/2008 | Bausov et al. | 299/1.2 |
| 2010/0259091 | A1 * | 10/2010 | Hackelboerger et al. | 299/10 |

FOREIGN PATENT DOCUMENTS

| | | |
|---|---|---|
| DE | 82 24 441 | 2/1983 |
| DE | 38 06 224 | 9/1989 |
| DE | 10 2005 005 869 | 8/2006 |
| EP | 0 412 400 | 2/1991 |
| GB | 2 129 032 | 5/1984 |
| SU | 1 523 661 | 11/1989 |

OTHER PUBLICATIONS

International Search Report in German.

* cited by examiner

*Primary Examiner* — Sunil Singh
(74) *Attorney, Agent, or Firm* — Collard & Roe, P.C.

(57) ABSTRACT

A method and a device can be used to monitor the travel path of a cutting extraction machine (1), particularly one used in coal mining, which can be moved along the working front (10) equipped with a face conveyor (9) and an advancing support (12, 13) in longwall mining. Despite extremely poor viewing conditions, the method and device determine hindrances that might be present in the travel path of the extraction machine, in the form of shield caps that are standing low, or extendible cantilevers, sliding roof bars, or other attachments of the advancing support that are hanging down, or overloading of the conveyor, in order to be able to take measures to avoid disruptions in operation, in timely manner. The travel path of the extraction machine (1) is scanned by a radar measurement device (14) assigned to the extraction machine (1), and if a hindrance is determined, an alarm is triggered and/or intervention into the control of the extraction machine (1) takes place.

10 Claims, 1 Drawing Sheet

METHOD AND DEVICE FOR MONITORING A CUTTING EXTRACTION MACHINE

CROSS REFERENCE TO RELATED APPLICATIONS

Figure 1:
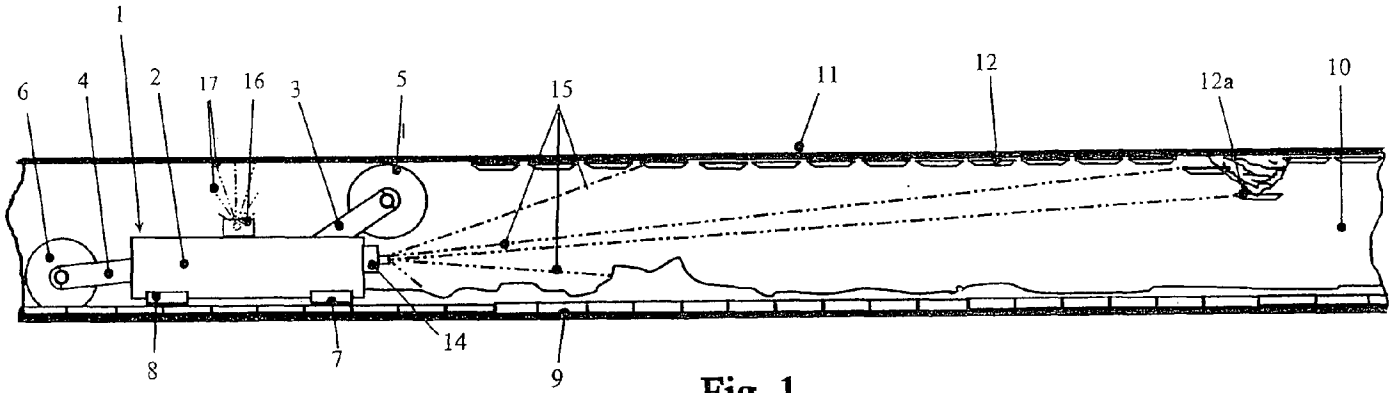

This application is the National Stage of PCT/EP2008/006589 filed on Aug. 9, 2008. The international application under PCT article 21(2) was not published in English.

The invention relates to a method and a device for monitoring the travel path of a cutting extraction machine, particularly one used in coal mining, which can be moved along the working front in longwall mining, in a face equipped with a face conveyor and advancing support.

In the automatic control or remote control of cutting extraction machines used in longwall mining, it has proven to be extraordinarily difficult to monitor the travel path of the cutting extraction machine for hindrances. For this reason, it constantly happens, when cutting extraction machines are used in this way, that the cutting drum or the support arm tip of the extraction machine collides with shield caps that are standing low, or extendible cantilevers, sliding roof bars, or other attachments of the advancing support that are hanging down, and/or that the extraction machine or the face conveyor get stuck, because the conveying belt side of the face conveyor is overloaded to such an extent that the tunnel cross-section under the extraction machine becomes blocked, so that material that comes afterward gets into the cable channel and, by way of the brackets, into the travel path. In order to prevent disruptions in operation and damage caused in this manner, the travel path of the cutting extraction machine must be reliably monitored for the presence of such hindrances, in order to be able to intervene accordingly in timely manner, i.e. to shut the machine down or to control the cutting process in such a manner that overloading of the conveying belt side of the face conveyor is avoided. Conventionally, this is done by a machine operator who accompanies the extraction machine during its travel through the face.

Because of the burdensome working conditions in the immediate vicinity of the cutting extraction machine, of course there has been no lack of attempts to automate these monitoring processes or to undertake them remotely, at a greater distance from the extraction machine. However, the optical viewing devices that are used in this connection have proven to be problematical, since the viewing conditions in the immediate vicinity of the extraction machine are very disadvantageous because of the dust that is formed there and the water mist that is sprayed out to combat the dust.

It is therefore the task of the invention to create a method and devices that allow reliable monitoring of the travel path of the extraction machine, despite dust and water mist, without having to depend on a machine operator who works in the immediate vicinity of the extraction machine.

The object of the invention is, first of all, a method for monitoring the travel path of a cutting extraction machine, particularly one used in coal mining, which can be moved along the working front in longwall mining, in a face equipped with a face conveyor and advancing support, whereby this method is characterized in that the travel path of the extraction machine is scanned in the direction of travel of the extraction machine, by means of a radar measurement device assigned to the extraction machine, and that if a hindrance in the travel path is determined, an alarm is triggered and/or intervention into the control of the extraction machine takes place.

It has surprisingly been shown that it is possible to scan the relatively narrow travel path of the extraction machine, which is surrounded on at least three sides by metallic equipment (caps and props of the support, face conveyor), with a radar measurement device, in such a manner that hindrances in the free cross-section of the travel path can be detected. In this connection, this measurement process is hardly impaired at all by dust and water mist. If the hindrance consists, for example, of a cap of the support that is standing low, an alarm is triggered and the extraction machine is shut down until this hindrance has been removed. If the hindrance consists, on the other hand, only of overloading of the conveyor, intervention into the control of the extraction machine takes place in such a manner that the amount of extraction material that has been cut loose is reduced to such an extent that overloading of the conveying belt side of the face conveyor is avoided.

It is practical if scanning of the region below the face ceiling takes place at a distance of more than 6 m from the radar device, and scanning in the region of the conveying belt side of the face conveyor takes place at a distance of 0.5 to 6 m from the radar measurement device.

A practical supplementation of the method according to the invention provides that another radar measurement device assigned to the extraction machine additionally scans the contours of the working front and any outcrops in the ceiling with a viewing direction onto the working front, along a vertical section of the working front, and that if irregularities in the contour of the head end or outcrops in the ceiling are found, the extraction machine is controlled to take these irregularities or outcrops into consideration. In this manner, it is possible to take these possible hindrances in the travel path appropriately into consideration, and to do so without the involvement of operating personnel or auxiliary personnel, to the greatest possible extent.

For evaluation, the measurement results of the scanning procedures are entered, as points, into a virtual model of the space to be monitored, which has been compiled previously. The current virtual model that comes about in this way is subjected to a cluster analysis, with path triggering or time triggering. As a function of the result of this cluster analysis, an alarm is then triggered, or intervention into the control of the extraction machine takes place.

A path-triggered measurement with path distances of about 10 cm is particularly suitable for the detection of support caps that are standing low, are fixed in place relative to the extraction machine and yield a clearly distinguishable radar echo, while they are still located at a greater distance. Time-triggered scanning with time cycles of 1 second, for example, on the other hand, is particularly suitable for monitoring of the rapidly moving conveyed material on the conveying belt side of the face conveyor, which takes place at short intervals.

Furthermore, the object of the invention is a device for monitoring the travel path of a cutting extraction machine, particularly one used in coal mining, which can be moved along the working front in longwall mining, in a face equipped with a face conveyor and advancing support, characterized by a radar measurement device that is assigned to the extraction machine and can be moved together with the extraction machine, whose measuring tool scans the travel path of the extraction machine for hindrances, seen in the direction of travel, and that triggers an alarm and/or intervenes in the control of the extraction machine if a hindrance in the travel path is determined. This device is intended for carrying out the method explained above.

A preferred embodiment of this device provides that the measurement tool of the radar measurement device is configured, disposed, and oriented in such a manner that on the one hand, it detects the radar echo of support caps at a distance of more than 6 m from the radar measurement device in the region of the face ceiling, and, on the other hand, detects the radar echo of the conveyed goods lying on the face conveyor at a distance of 0.5 to 6 m from the radar measurement device, in the region of the conveying belt side of the face conveyor.

A radar measurement device having such a measurement tool therefore scans a distant region of the travel path, where the risk proceeds from shield caps that are standing low, or extendible cantilevers, sliding roof bars, or other attachments of the advancing support that are hanging down, on the one hand, and the near region in front of the radar measurement device, where the risk proceeds essentially from overloading of the face conveyor, on the other hand. Furthermore, the measurement tool can additionally scan a vertical section of the working front and the adjacent ceiling.

It is practical if it is furthermore provided that the measurement tool of the radar measurement device is oriented to be inclined at an angle of 2° to 4° relative to the head end. In this way, the result is achieved that the radar measurement can better scan the head end and the adjacent ceiling, and, in particular, is less affected by radar echoes that proceed from the props of the support row and/or the brackets of the belt conveyor, particularly in the distant region. Furthermore, an inclination of the axis of the radar measurement device by 2° to 10° in the direction relative to the face ceiling is practical. In this way, the face ceiling can be scanned at a slight distance, in view of the symmetrical opening angle of the radar.

Figure 2:
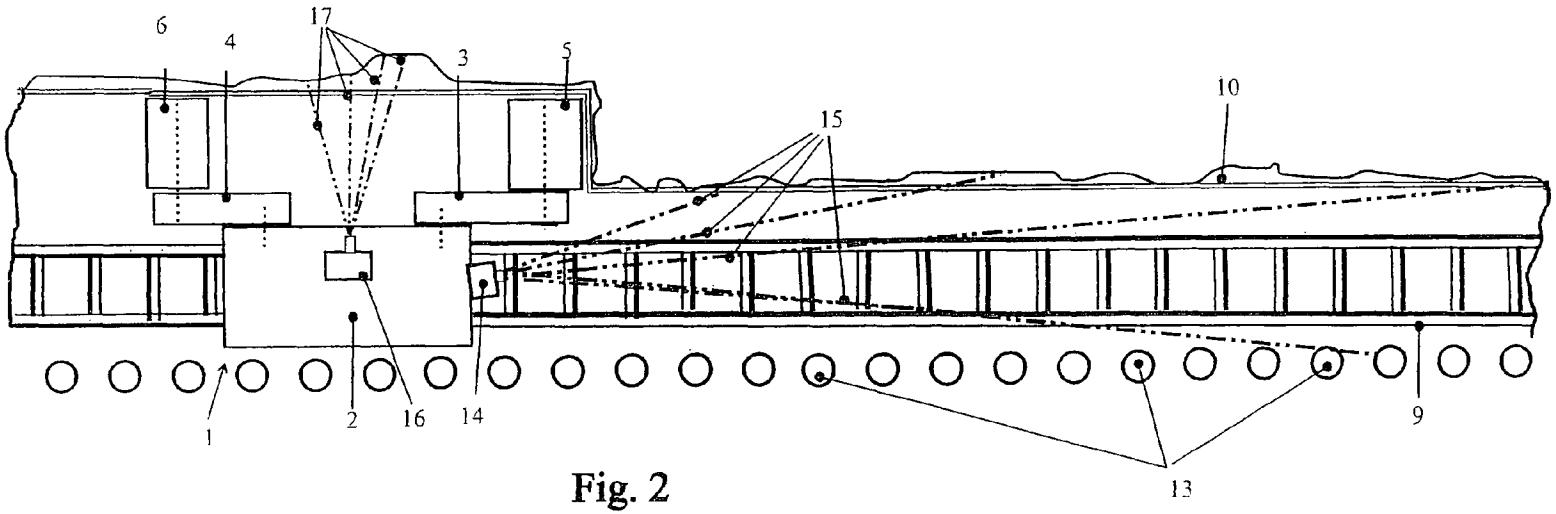

An exemplary embodiment of the invention will be described in greater detail in the following, using the drawings. These show:

FIG. 1: Schematically, a side view of a cutting extraction machine and of the face, in a side view;

FIG. 2: Schematically, a top view of FIG. 1.

The drawing shows a cutting extraction machine, referred to in its totality with the reference symbol 1, which is configured as a cutter loader here. The extraction machine has a machine body 2 that is provided with pivot arms 3 and 4 at the front and the rear, on which cutting rollers 5 and 6 are mounted. The machine body 2 is carried by chassis 7 and 8 that can be moved on a face conveyor 9, which serves as a travel track at the same time. The face conveyor 9 is configured as a scraper conveyor whose upper belt side serves as a conveying side and whose lower belt side serves as the return side for the chains and the scrapers. The machine body 2 is mounted on the chassis 7 and 8 in such a manner that the conveying belt side of the face conveyor 9 is surrounded by the extraction machine 1 in the manner of a portal, so that extraction material that lies on the conveying belt side of the face conveyor can pass through the extraction machine 1.

The face conveyor 9, which simultaneously serves as the travel track for the extraction machine, is laid along a working front 10 in a face, whose face ceiling 11 is supported by support caps 12, which in turn are carried by props 13. Only a few of the support caps 12 and the props 13 are shown in the drawing.

According to the invention, a radar measurement device 14 is attached to the machine body 2 of the extraction machine 1, on its side that lies in the front in the direction of travel; the measurement tool 15 of this device scans the travel path of the extraction machine 1, which is kept free of the face support 12, 13, for any hindrances that might be there. In this connection, the radar measurement device 14 and its measurement tool 15 are configured, disposed, and oriented in such a manner that the axis of the measurement tool 15 runs inclined at an acute angle of 2° to 4° relative to the working front 10.

The measurement tool 15 scans a distant region that has a distance of more than 6 m from the radar measurement device 14, in the region of the face ceiling, on the one hand, and a close region situated immediately above the conveying belt side of the face conveyor 9, on the other hand, which has a distance of 0.5 to 6 m from the radar measurement device 14.

Furthermore, an additional radar measurement device 16 is installed on the machine body 2 of the extraction machine 1, whose measurement tool 17 is directed at the working front 10 and scans a vertical section of the working front 10 and the adjacent face ceiling 11 for irregularities and outcrops.

The measured radar echoes of each scanning process are entered into a previously compiled virtual model of the space to be monitored, as points. The virtual model that comes about in this manner and is constantly updated is subjected to a cluster analysis, either continuously or at regular intervals. The presence of point clusters in this model then permits the conclusion, in each instance, that a hindrance is present in the travel path of the extraction machine 1, at the measured location, or that the shield caps delimit the face space toward the ceiling.

The radar echoes from the distant region and the near region that are measured by the radar measurement device 14 are stored in memory in two different models, by distant region and remote region, and are evaluated differently. The evaluation in the distant region, where the support caps 12 and 12*a* are particularly supposed to be detected, works with path triggering, at path intervals of 10 cm, in each instance. The evaluation in the near region, where overloading of the conveying belt side of the face conveyor 9 is particularly supposed to be detected, takes place, in contrast, with time triggering, at time cycles of one second, for example.

As a function of the hindrances that are found, in each instance, an alarm is then triggered and the extraction machine is shut down, or intervention into the control of the extraction machine takes place, in such a manner that the operational problems to be feared are avoided right from the start.

In deviation from the exemplary embodiment shown, the radar measurement device can also, if necessary, be attached to the extraction machine 1 in such a manner that it can be turned depending on the direction of travel. Likewise, it is also possible to install two measurement devices on the extraction machine 1, specifically one in each direction of travel.

The invention claimed is:

1. A method for monitoring the travel path of a cutting extraction machine, which can be moved along the working front equipped with a face conveyor and an advancing support in longwall mining, the method comprising the steps of:

scanning a travel path of the extraction machine in the direction of travel of the extraction machine via a radar echo measurement device, and if a hindrance in the travel path is determined, performing at least one first response condition, the at least one first response condition being selected from the group consisting of:

triggering an alarm, and intervening into the control of the extraction machine, wherein the hindrance is selected from the group consisting of:

shield caps that are standing low, extendible cantilevers that are standing low, sliding roof bars that are standing low, attachments of the advancing support that are hanging down, and overloading of the conveying belt of the face conveyor, in the region of the conveying belt side of the face conveyor.

2. The method according to claim 1, wherein the scanning is of a region below the face ceiling and takes place at a distance of more than 6 m from the radar echo measurement device.

3. The method according to claim 1, further comprising the steps of:

scanning the contour of the working front and any outcrops in the face ceiling using an additional radar echo measurement device, with a viewing direction onto the working front, along a vertical section of the working front, and if a condition is found, controlling the extraction machine to take the condition into consideration, the condition being selected from the group consisting of:

irregularities in the contour of the working front, and outcrops in the face ceiling.

4. The method according to claim 1, further comprising the steps of:

entering the measurement results of each scanning procedure as points into a virtual model of the space to be monitored, which has been compiled previously, subjecting the current virtual model that comes about in this way to a cluster analysis, with path triggering or time triggering, and performing at least one second response condition as a function of the result of this cluster analysis, the at least one second response condition being selected from the group consisting of:

triggering an alarm, and intervening into the control of the extraction machine.

5. The method according to claim 1, wherein the scanning is in the region of the conveying belt side of the face conveyor and takes place at a distance of 0.5 to 6 m from the radar echo measurement device.

6. A device for monitoring the travel path of a cutting extraction machine, which can be moved along a working front in longwall mining, in a face equipped with a face conveyor and an advancing support, comprising a radar echo measurement device that can be moved together with the extraction machine, whose measuring tool scans the travel path of the extraction machine, seen in the direction of travel, and that performs at least one response condition if a hindrance in the travel path is determined, the at least one response condition being selected from the group consisting of:

triggering an alarm, and intervening in the control of the extraction machine, and wherein the hindrance is selected from the group consisting of:

shield caps that are standing low, extendible cantilevers that are standing low, sliding roof bars that are standing low, attachments of the advancing support that are hanging down, and overloading of the conveying belt side of the face conveyor in the region of the conveying belt side of the face conveyor.

7. The device according to claim 6, wherein the measurement tool of the radar echo measurement device is configured, disposed, and oriented in such a manner that on the one hand, it detects the radar echo of support caps at a distance of more than 6 m from the radar echo measurement device in the region of the face ceiling, and, on the other hand, detects the radar echo of the conveyed goods lying on the face conveyor at a distance of 0.5 to 6 m from the radar echo measurement device, in the region of the conveying belt side of the face conveyor.

8. The device according to claim 6, wherein the axis of the measurement tool of the radar echo measurement device runs inclined at an angle of 2° to 4° relative to the working front.

9. The device according to claim 6, wherein the axis of the measurement tool of the radar echo measurement device runs inclined at an angle of 2° to 10° relative to the face ceiling.

10. The device according to claim 6, further comprising an additional radar echo measurement device, directed at the working front, which scans the contour of the working front along a vertical section of the working front and any outcrops of the adjacent face ceiling.

* * * * *